US006135762A

United States Patent [19]

Hu

[11] Patent Number: 6,135,762

[45] Date of Patent: Oct. 24, 2000

[54] AUTOMATIC SECURITY GAS HOLDING DEVICE FITTED IN AN IGNITER

[76] Inventor: Ke Ren Hu, 21 Hua Sheng Road, Bei Er Huan Xian, Cixi City, Zhe jiang Province, P.R., 315300, China

[21] Appl. No.: 09/356,632

[22] Filed: Jul. 19, 1999

[30] Foreign Application Priority Data

May 21, 1999 [CN] China ..... 99113727

[51] Int. Cl.[7] ..... F23D 11/36

[52] U.S. Cl. ..... 431/153; 431/255

[58] Field of Search ..... 431/153, 255, 431/277

[56] References Cited

U.S. PATENT DOCUMENTS 5,437,549 8/1995 Saito ..... 431/153
5,494,436 2/1996 Hwang ..... 431/153
5,496,169 3/1996 Chen ..... 431/153
5,667,377 9/1997 Lin ..... 431/255
5,967,768 10/1999 Saito et al. ..... 431/153
6,010,328 1/2000 Sung ..... 431/153

*Primary Examiner*—Ira S. Lazarus
*Assistant Examiner*—Josiah C. Cocks
*Attorney, Agent, or Firm*—Merchant & Gould, P.C.

[57] ABSTRACT

An automatic security gas holding device fitted in an igniter includes a security button, a compression spring, a fitting hole provided on the main igniter body, a second supporting rib with a guide hole, a swing arm with a horizontal portion, an upper boss portion and a lower boss portion. The swing arm is pivotedly fitted through a shaft to one end of the security button and makes use of the top end of its upper boss portion near the top end of an actuating plunger of the button, and makes use of the top end of its lower boss portion near the upper surface of a seesaw. When the user finishes using the igniter fitted with the security gas holding device, the security button automatically returns to a security state relying on the interior spring action to greatly raise the safety factor of the electronic igniter.

2 Claims, 3 Drawing Sheets

AUTOMATIC SECURITY GAS HOLDING DEVICE FITTED IN AN IGNITER

FIELD

The present invention relates to a safety device in an igniter, particularly to an automatic security gas holding device fitted in an igniter to prevent the igniter all along from releasing gas so as to make it beyond lighting a fire in case of a user to press only the ignition button.

BACKGROUND

The igniter is a kind of ignition apparatus used for kitchen fire lighting, picnics and other occasions in daily life requiring a fire. Owing to its widespread usage and ease in using, it is welcomed more and more by numerous families; however, a certain danger is created owing to combustible gas in it. Hence the safety of its use has attracted more and more people's attention.

In the prior art, an igniter is generally composed of a vapor box, an electronic kindling device, a gas valve system, and an ignition trigger or button, etc. This kind of igniter, when in, will easily be ignited by pressing down an operating trigger on it such as a fingerpiece or button. However, to certain persons, particularly children, they do not know how to properly use the igniter and may light a fire at random and result in certain accidents, so it is very unsafe.

In order to raise the safety of igniters, there have occurred a lot of igniters with safety device all over the world, such as rotation blocking devices, and poking switches. However, their basic structure and principle are very much the same and have adopted a mode of restricting ignition button motion, i. e. to have a security switch fitted on an igniter body able to be pushed to and fro. That security switch can move from a locked state to an unlocked state, i. e. it has two positions "opened" and "closed" . When the security switch is at the "closed" position, a boss stretching into the igniter body restricts the motion of the button and the user's finger is unable to easily press down the button. When the security switch is placed at the "opened" position or unlocked state, the boss of the security switch separates from the button and the igniter can be used as normal. However, a user normally pokes the security switch by hand from the "closed" position to the "opened" position to light the fire, but after finishing using the igniter he will often forget to restore the security switch to the original "closed" position owing to carelessness, i. e. the switch remains at the "opened" position. In this way, two very big problems can happen. The first problem: as mentioned above, the security switch can no longer play the role of safety locking, hence the above-mentioned ignition will randomly happen, particularly at the time of being taken by children for playing, thereby easily causing accidents. The second problem: such kind of security switch adopts a "holding back" mode to achieve the security goal. In case the user, because of carelessness and without placing the security switch at "opened" position, makes direct use of the igniter, then there will be no affect under normal efforts. But at seeing the igniter unable to light a fire, the button will be pressed by much larger force, such that there will be possible damage to the igniter and thereby causing the vapor box or gas releasing valve system to spill a small amount of gas. This is not only unsafe but also lowers the service life of the igniter.

SUMMARY

The primary object of the present invention is to provide an automatic security gas holding device fitted in an igniter and having an automatic security gas holding flmction, with which after lighting a fire by the igniter, the security switch can automatically restore from the "opened" position to the "closed position, so as to always place the security switch at a locked state relative to the ignition button and to have the gas releasing valve system never actuated with just pressing the ignition button alone.

The technical scheme of the present invention is as follows: An automatic security gas holding device fitted in an igniter is used in electronic igniters to realize automatic securing. The igniter generally comprises a main igniter body composed of left and right bodies, an igniter barrel, a vapor box, a button with an actuating plunger, a piezoelectric device with a piezoelectric block, a gas releasing valve system with a gas releasing orifice, a seesaw and a security gas holding device. The security gas holding device comprises:

- a security button with its one end provided with a shaft hole, another end movably disposed in a fitting hole in a mode of protruding out of or being partly exposed outside the fitting hole of the main igniter body;
- a swing arm comprising a horizontal portion, an upper boss portion vertically extending upward from the front of the horizontal portion and a lower boss portion vertically extending downward from the front of the horizontal portion, the swing arm being pivotedly fitted via a shaft to one end of the security button with the shaft hole and making the top end of its upper boss portion be adjacent to the top end of the plunger of the button, and making the top end of its lower boss portion be adjacent to the upper surface of the seesaw;
- a compression spring sleeved on the security button, and placed between a wall with the fitting hole of the main igniter body and a second supporting rib having a guide hole;
- the fitting hole and the second supporting rib having the guide hole are both disposed on the main igniter body fitted with the security gas holding device.

In the automatic security gas holding device fitted in the igniter as mentioned above, a fitting hole is provided on the side fringe of the main igniter body fitted with the automatic security gas holding device adjacent to the button an a second supporting rib having a guide hole is provided on the inner wall right opposite the fitting hole.

In the automatic security gas holding device fitted with the igniter as mentioned above, the inner side of the upper boss portion of the swing arm is inclined into a wedge shape, and the lower boss portion is in a rod shape.

In the automatic security gas holding device fitted in the igniter as mentioned above, another end of the security button is movably erected in the guide hole and the fitting hole in a mode of protruding out of, or being partly exposed outside, the fitting hole of the main igniter body.

Therefore, it is more and more important to provide a device having an automatic security gas holding function, wherein, after lighting a fire by the igniter, the security switch can automatically restore from the "opened" position to the "closed" position and the gas releasing valve system will never actuate by just pressing the ignition button alone. Precisely out of such an important requirement, the present invention will change the security device of an igniter from the mode of restricting the ignition button motion to a mode of suspending the ignition button thereby rendering it ineffective. The present device comprises: a security button, a swing arm, a compression spring, and a fitting hole on the main igniter body for fitting the present device and a second supporting rib with a guide hole. Hence, when using the igniter, the user presses the security button that is partly exposed outside the fitting hole with the user's thumb. The security button will overcome the acting force of the compression spring and move downward along the guide hole. The swing arm pivotedly connected together with the security button will also move downward accordingly. The wedge-shaped portion of the upper boss portion of the swing arm will then come into contact with the ignition button, and the top end of the red-shaped lower boss portion of the swing arm will also come into contact with the seesaw. At this moment, pressing the ignition button will bring the swing arm into counterclockwise rotation, and the swing arm will again bring the seesaw into rotation to make the gas releasing valve system release gas. The igniter can then light a fire. However, when the user finishes using, after the finger separates from the igniter body, the security button, under the restoring force of the compression spring, will automatically move upward along the guide hole to bring the swing arm into separation from contact with and the seesaw, and to make one end of the ignition button and one end of the seesaw both in a suspending state, and the igniter will automatically enter the security state. At this moment, if only the igniter button is being pressed, there will never be any possibility of damaging the igniter, nor of leaking gas, nor occurrence of a dangerous condition owing to carelessness and without adopting security measures.

BRIEF DESCRIPTION OF THE DRAWINGS

A detailed description of the specific structure and operating process of an embodiment of the automatic security gas holding device of the present invention in combination with the accompanying drawings is given as follows.

DETAILED DESCRIPTION

Figure 1:
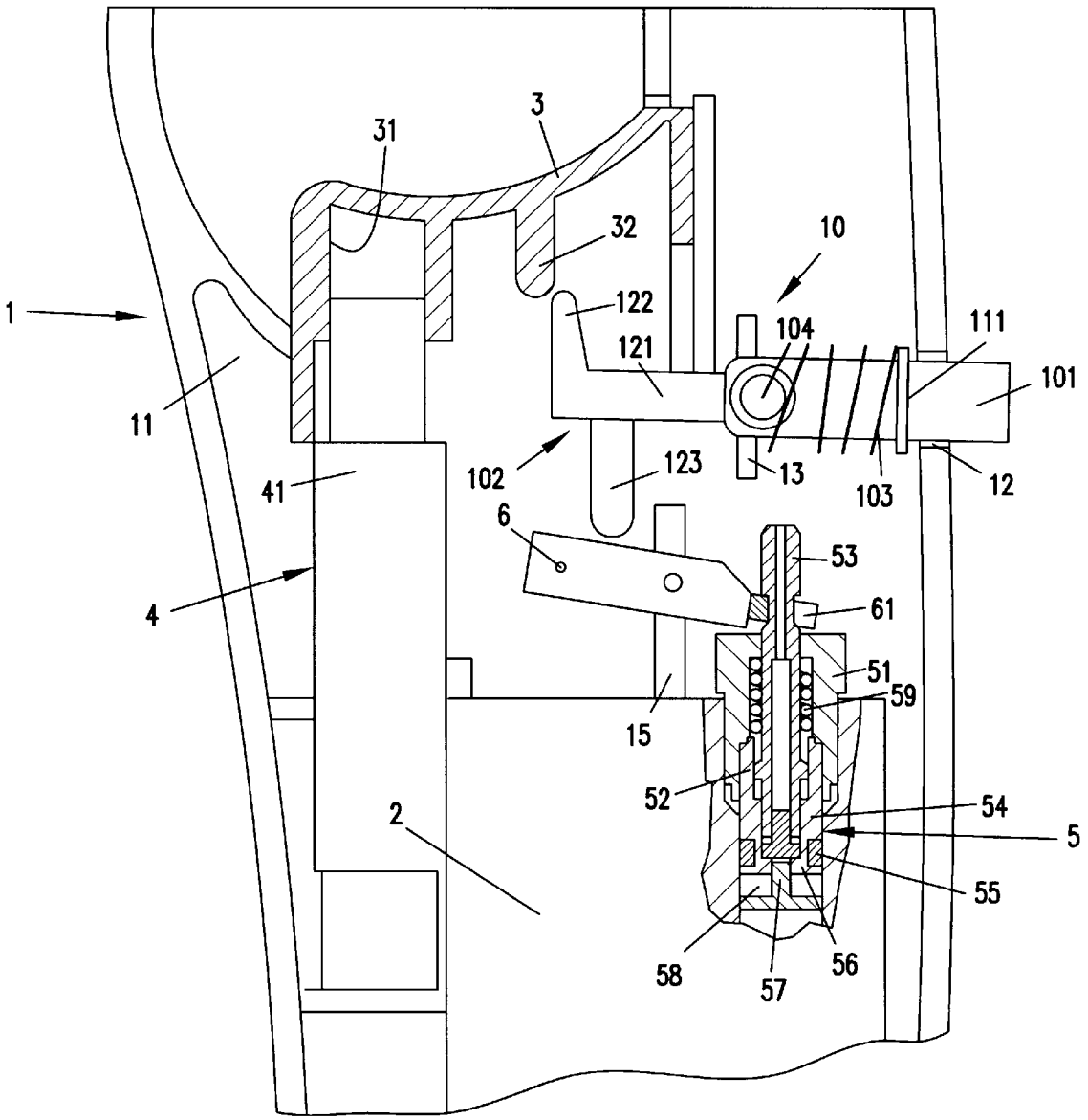
FIG. 1 is a partial structural sectional view of the present invention.

Referring to FIG. 1, an automatic security gas holding device fitted in the igniter is shown wherein, the igniter comprises a main igniter body 1, an igniter barrel (not shown), a vapor box 2, an ignition button or button 3, a piezoelectric device 4, a gas releasing valve system 5, a seesaw 6 and security gas holding device 10. The main igniter body 1 is a hollow handle composed of left and right bodies, only the right igniter body 11 being shown at its right.

The igniter barrel is generally a metallic tube fitted by use of a fixing sleeve at the right upper portion of the main igniter body 1.

The vapor box 2 is a gas storing box of ordinary structure filled inside with combustible gas in a liquid state and disposed in the main igniter body 1 at a position of the lower portion of main igniter body.

On the back behind the smooth upper surface of the button 3 there is provided an assembly hole 31 located at one side and an actuating plunger 32 adjacent to the central position and perpendicular to a horizontal line.

The piezoelectric device 4 contains a piezoelectric block 41 and is disposed in the main igniter body 1 at the left side of the vapor box 2, with one end of the piezoelectric block 41 inserted into and matching the assembly hole 31.

The gas releasing valve system 5 comprises upper and lower sleeves 51, 52, a gas releasing needle 53, a gas releasing spring 54, a T-shaped header 55, a copper seat 56, a zinc nail 57, a sponge washer 58 and a spring 59, etc. The gas releasing valve system 5 after being assembled together is fitted through the upper and lower sleeves 51, 52 on the outlet of the vapor box 2. The gas releasing needle 53 is generally in a close state to the vapor box 2, and a recess is provide on the needle body of its exposed upper sleeve 51. When the seesaw 6, by the help of the recess, lifts the gas releasing needle 53 , gas can spill out of the needle orifice.

The seesaw 6 is a plate with one end having a fork position 61. The middle of the plate is provided with a hole through which a dowel 62 is pivotedly fitted on a first supporting rib 15 located on the upper side of the vapor box 2, while the fork position 61 of its one end forks the needle body recess and clips the gas releasing needle 53.

All the above components are members of conventional igniters, and the detailed composition and arrangement will be elaborated herein no more.

In the present invention, the security gas holding device includes a security button 101, which is a slender rod with one end provided with a shaft hole, in the middle front provided with a collar 111, and through which its rod portion can be movably erected on a guide hole 14 and fitting hole 12, while another end protrudes out of or is partly exposed outside the fitting hole 12 of the main igniter body 1, and to make the collar 111 abut on the inner wall of the fitting hole 12.

The security gas holding device further includes a swing arm 102, which is a special-shaped member composed of a horizontal portion 121. A wedge-shaped upper boss portion 122 is located at the front of the horizontal portion 121, and vertically extends upward with an inclined inner side. A lower boss portion 123 extends vertically downward. The tail of the horizontal portion 121 is provided with a shaft hole, through which a shaft 104 is pivotedly connected with one end of the security button 101. The top end of the upper boss portion 122 is adjacent relatively to the top end of the actuating plunger 32 of button 3 and the top end of the lower boss portion 123 is adjacent relatively to the upper surface of seesaw 6;

A compression spring 103 is slipped on the security button 101 and disposed between the wall with the fitting hole 12 and the second supporting rib 13, so as to make the security button 101 realize automatic securing through the restoring force of the spring.

The fitting hole 12, and the guide hole 14 provided on the inner wall of the main igniter body 1 opposite the fitting hole 12 and formed by the second supporting rib 13, are both realized on the main igniter body 1 fitted with the present device.

FIG. 1 shows the condition of the igniter in the secured state. The actuating plunger 32 of button 3 is in a suspending state, such that when pressing the button 3 with forefinger it is only possible to make the piezoelectric block produce sparks, while the swing arm 102 can not rotate because it is not contacted by the actuating plunger 32. The lower boss portion 123 adjacent to the swing arm will not work with the seesaw 6, and therefore the gas releasing needle 53 clipped together with the needle body with recess can not be lifted upward too, and the gas in vapor box 2 will not then spill out.

Figure 2:
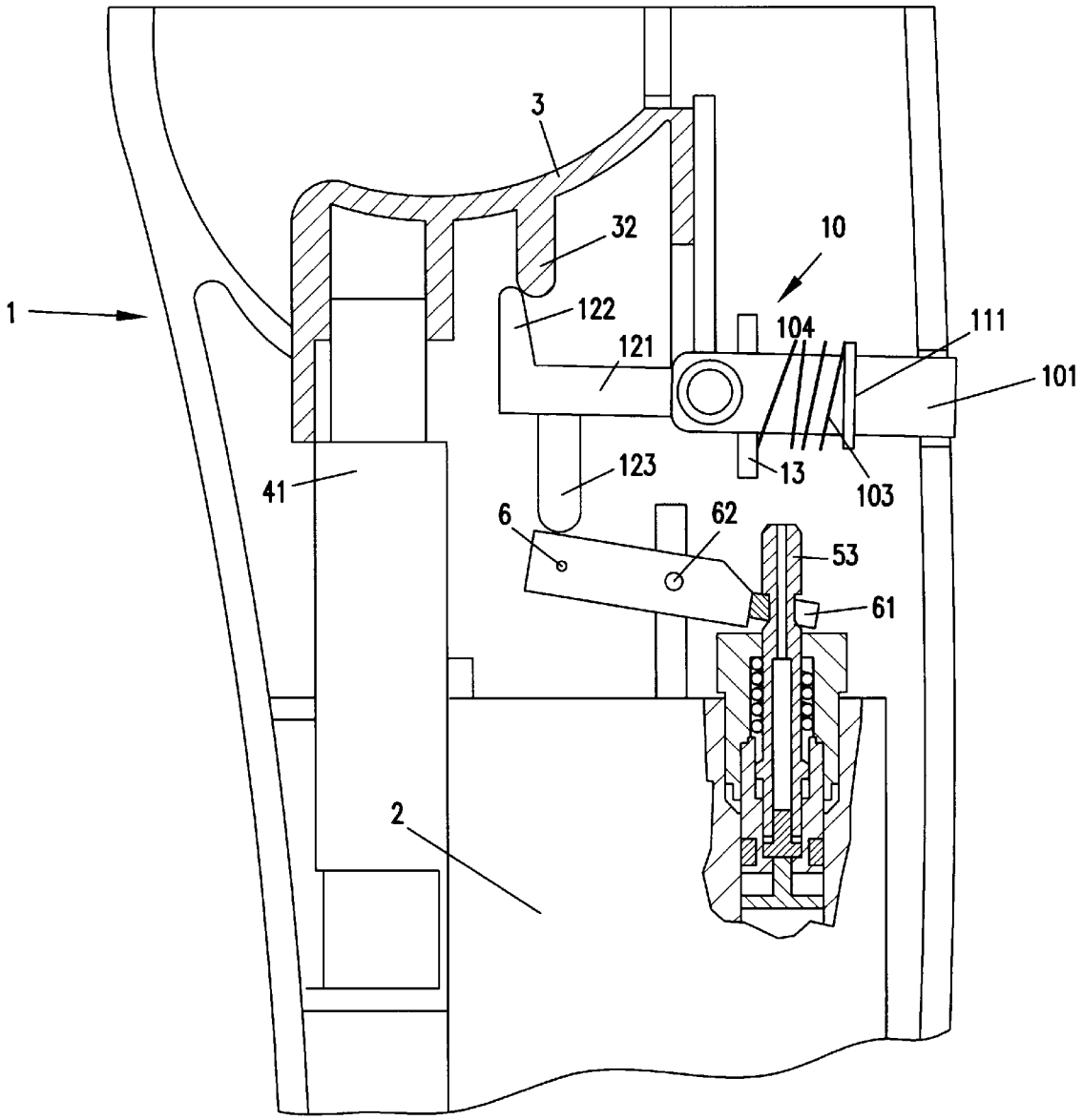
FIG. 2 is a view showing the relative position of the upper and lower boss portions of the swing arm respectively with the actuating plunger of the button and the upper surface of the seesaw after pressing the security button in FIG. 1.
Figure 3:
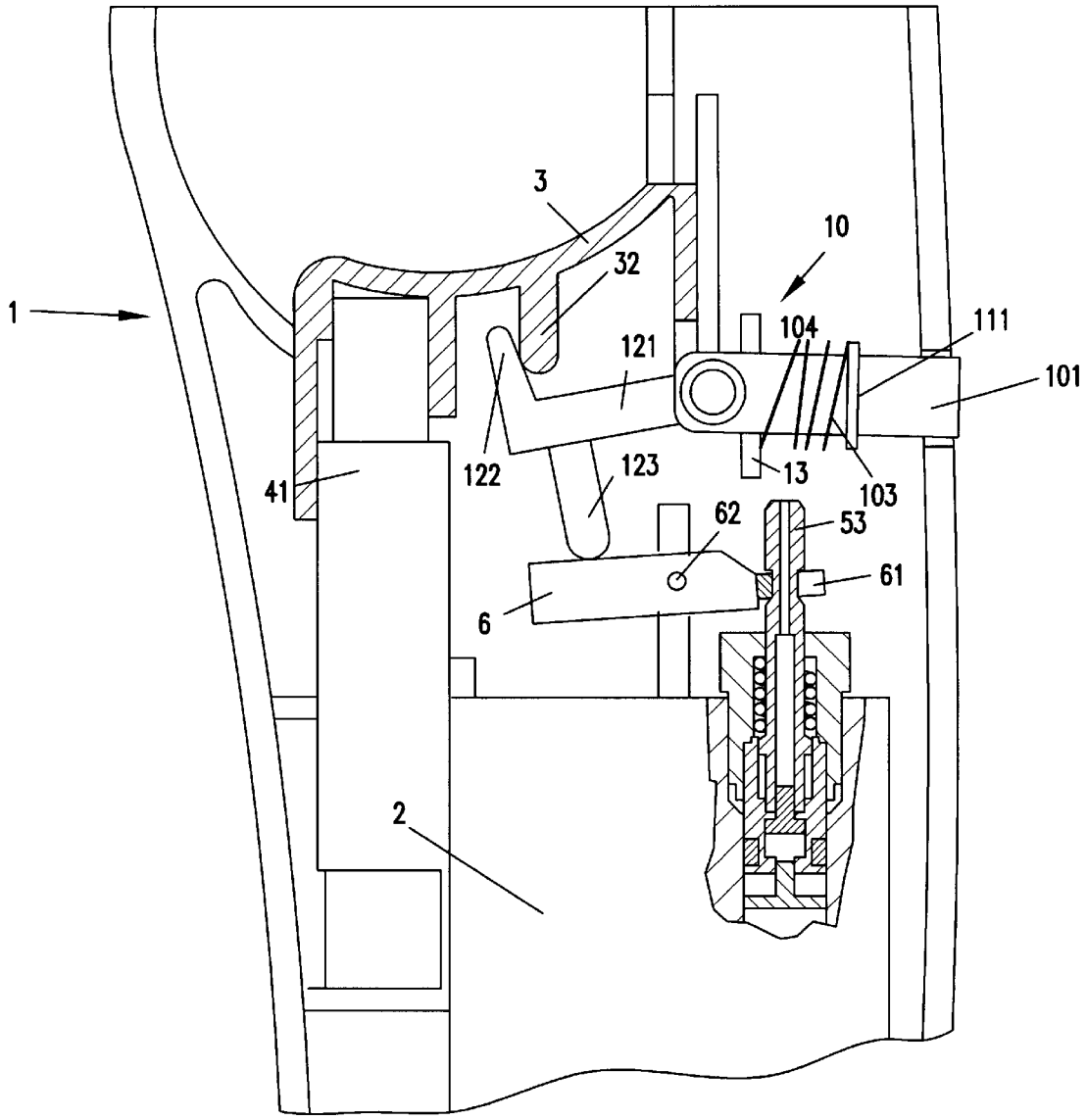
FIG. 3 is a view showing the upper and lower boss portions of the swing arm respectively with the actuating plunger of the button and the upper surface of the seesaw to act mutually and to make the gas releasing orifice of the gas releasing valve system at a gas releasing or ignition state after pressing the security button in FIG. 1 and further pressing down the ignition button.

Referring to FIGS. 2 and 3 as shown, when the igniter is in use, first of all, the user presses the security button 101 with thumb to make it slide along the guide hole 14 on the igniter body. The swing arm 102 will make counterclockwise rotation around shaft 104, the wedge portion of its upper boss portion 122 will contact accordingly with the button 3, as shown in FIG. 2. Then the user presses the button 3, as shown in FIG. 2. When the user presses the button 3 with a forefinger to bring the swing arm 102 into counterclockwise rotation, the top end of lower boss portion 123 of the swing arm 102 is in contact with the upper surface of the seesaw 6 to bring the seesaw 6 into counterclockwise rotation, and thereby lift the gas releasing needle 53 of the gas releasing valve system 5 upward and to lead out gas from the vapor box 2, through the gas releasing needle 53 and a silicon-rubber tube (not shown) to the head of the igniter barrel. Simultaneously, as the button 3 actuates the piezoelectric block 41 to produce sparks at the head of the igniter barrel, the igniter will then realize lighting a fire.

When the user finishes using, the security button 101, under the action of spring 103, will automatically restore its position along the guide hole 14. The swing arm 102 accordingly separates itself from the button 3, and the igniter automatically returns to a secured state. In case the security button 101 is not being pressed, then the actuating plunger 32 of button 3 will always remain in a suspended state, and there will never be any possibility of igniting the igniter or releasing gas. But also, the spring 103 of the security device must have a certain force able to be pressed down, so as to effectively prevent any hidden peril of accidents induced from playing by children and to satisfactorily solve drawbacks of existing igniters.

What is claimed is:

1. An automatic security gas holding device fitted in an igniter, the igniter including a main igniter body composed of left and right igniter body portions, a barrel, a vapor box, a button with an actuating plunger, a piezoelectric block, a gas releasing valve system with gas releasing orifice, and a seesaw, the security gas holding device comprising:

a fitting hole formed in the main igniter body and a supporting rib disposed in the main igniter body, the supporting rib including a guide hole;

a security button with one end provided with a first shaft hole, and another end movably disposed in said fitting hole and protruding out of the main igniter body;

a swing arm including a horizontal portion with a front and a tail, an upper boss portion extending vertically upward from the front of the horizontal portion, and a lower boss portion extending vertically downward from the front of the horizontal portion, the tail of the horizontal portion includes a second shaft hole, and a shaft is pivotally fitted in the first shaft hole and the second shaft hole such that a top end of the upper boss portion is located adjacent to a top end of the actuating plunger and a top end of the lower boss portion is located adjacent to an upper surface of the seesaw; and a compression spring sleeved on the security button and positioned between the main igniter body and the supporting rib.

2. The automatic security gas holding device according to claim 1, wherein the upper boss portion includes an inner side that is inclined into a wedge shape, and the lower boss portion has a rod shape.

* * * * *